US006094177A

United States Patent [19]

Yamamoto

[11] Patent Number: 6,094,177

[45] Date of Patent: Jul. 25, 2000

[54] PLANAR RADIATION ANTENNA ELEMENTS AND OMNI DIRECTIONAL ANTENNA USING SUCH ANTENNA ELEMENTS

[76] Inventor: Kiyoshi Yamamoto, No. 32-2, Midoridai 1 chome, Uchinada-machi, Kohoku-gun, Ishikawa-ken, Japan

[21] Appl. No.: 09/199,997

[22] Filed: Nov. 24, 1998

[30] Foreign Application Priority Data

Nov. 27, 1997 [JP] Japan ..... 9-340853

[51] Int. Cl.[7] ..... H01Q 9/16

[52] U.S. Cl. ..... 343/806; 343/741; 343/866; 343/890

[58] Field of Search ..... 343/802, 803, 343/804, 806, 810, 812, 866, 867, 741, 742, 890

[56] References Cited

U.S. PATENT DOCUMENTS 2,980,912 4/1961 Anderson ..... 343/802
4,054,877 10/1977 Bogner et al. ..... 343/806

FOREIGN PATENT DOCUMENTS 8-112101 of 1996 Japan .
8-267725 of 1996 Japan .
9-179143 of 1997 Japan .

OTHER PUBLICATIONS

Antenna Handbook published May 30, 1994, *Hentena*, pp. 185–186.

*Let's Haming* magazine, published 1996, No. 68, pp. 33–62 "The Fancy Crazy Zippy" the story of , from birth of hentena to application.

*Primary Examiner*—Don Wong
*Assistant Examiner*—Hoang Nguyen
*Attorney, Agent, or Firm*—Jones, Day, Reavis & Pogue

[57] ABSTRACT

An antenna of the long frame-type wherein the ratio between the long side and the short side is between 1:4 and 1:8 and the length of the long side is equivalent to one wavelength of the central frequency. One pair of short bars are deployed so that they are located at a distance corresponding to ¼th to ¼0th of the distance from both end parts of the entire long side length of each long side element. The two end portions of the long side of the antenna is symmetrically bent with respect to a central portion such that the two end portions form an angle of 45 to 90 degrees with respect to the central portion and are parallel to each other.

5 Claims, 3 Drawing Sheets

PLANAR RADIATION ANTENNA ELEMENTS AND OMNI DIRECTIONAL ANTENNA USING SUCH ANTENNA ELEMENTS

This application claims priority under Japanese Application No. H9-340853 filed Nov. 27, 1997.

BACKGROUND OF THE INVENTION

1. Field of the Invention

This invention relates to antenna elements and an antenna using such elements for receiving high-frequency, or radio waves to enable reception of relay or repeater signals, broadcast and communication signals, etc.

2. Description of Related Art Including Information Disclosed Under 37 CFR 1.97 and 1.98

It is well known that radio waves are transmitted for use by relays or repeaters, by broadcasting and radio communication, and are received by radio antennas where they may be used to provide instructions or even for controlling traffic systems. Antennas for such use may be vertically mounted to a ground pole or may be a vertically mounted dipole, etc. However, since these antennas are usually set to a mode for receiving vertically polarized waves, it is usually not possible to achieve sufficient gain where antennas with such directional characteristics are used. In addition, super-gain antennas and similar antennas which are non-directional (omnidirectional) can also be used as a means for transmitting information such as TV broadcasts via radio waves. Unfortunately, these antennas have a complicated construction.

Planar radiation antennas, commonly called "modified antennas", are often used for amateur radio. The advantage of these antennas is that they have a high gain and they also make it possible to select any polarized wave mode. A disadvantage of these antennas is that it is difficult to obtain omnidirectional characteristics.

In view of the above-described problem, the inventor of this invention provides an antenna which not only makes it possible to freely select the polarized wave mode with a high gain, but which also has omnidirectional characteristics and which is suitable for a wide range of applications. The antennas and elements of this invention are suitable for broadcast to wide areas, for relaying, for communication, for traffic control system, and for mobile communications. The antennas can also be used for a wide range of frequencies including HF, VHF, and UHF.

SUMMARY OF THE INVENTION

In order to solve the above-mentioned problems in accordance with my invention, an omnidirectional antenna construction is provided which uses a planar radiation element equivalent to one wavelength of the central frequency being broadcast or transmitted. The antennas according to this invention are of a rectangular or frame construction and are provided with a short side and a long side element and the antenna has a feed point mounted at the long side. The ratio of the short side to the long side is between 1:4 and 1:8, and the length of the long side is identical to one wavelength of the central frequency of the radio wave being transmitted or received. A feeding means is located at about the central point of the long side and a short bar or conductor is mounted at a specific distance from both end points of the pair of long sides. The short sides are mounted on the left and right end points of the long sides and are symmetrical with respect to the central portion of the long side. The ends of the long side are bent at an angle of between 45 degrees to 90 degrees such that the end portion of the long side on the right-hand side (as shown in FIG. 1.) runs parallel to the end portion of the long side on the left. The bend on the left side at point A is at a specified distance from the central point and is identical to a distance at the bend at point B on the right side of the central point. In accordance with one antenna embodiment, the planar radiation element described above may be used with the horizontal or vertical wave polarization method. A first planar element of the type described above is located at the upper part of an upright insulation support column. A second planar element is spaced from the first planar element so as to correspond to a wavelength, or no less than one-half of a wavelength. The two spaced elements are also positioned so as to cross at an angle of 90 degrees with respect to each other and thereby resulting in an omnidirectional antenna. Such an omnidirectional antenna which uses a high-frequency distributor and such planar radiation elements enables simultaneous excitation either with the same phase for each element or with a phase difference of 90 degrees.

In accordance with another embodiment, the long side frame planar radiation element is again equivalent to one wavelength of a central frequency of radio waves. The ratio of the length of the long side with that of the short side of the antenna element is between 1:4 and 1:8, and the long side is formed in the shape of a regular polygon with an odd number of angles. One part of the long side is bent at a central point "C" in the center of the long side to create the center of the regular polygon. A constant gap is provided via an insulation member deployed between both ends of said pair of long sides opposite the central point of the long side. A feed means is formed in the region of the C-point which is bent to a specific distance toward the inner side of the regular polygon of the central part of the long side.

In accordance with another embodiment, the long side of the planar radiation element is equivalent to one-half wavelength rather than one wavelength, and has a regular polygon shape as discussed above. The ratio of the length of the long side to that of the short side of the element according to this embodiment is again between 1:4 and 1:8.

In accordance with still another embodiment having a regular polygon-type construction, the long side is equal to one-fourth of the central wavelength and the short side is equal to one-twelfth. The end of the outer side of a spider coil is located one-third of the wavelength from the feed point.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

FGS. 8A, 8B and 8C are side, top, and perspective views, respectively, of still another embodiment of the invention which uses a pentagonal design.

DETAILED DESCRIPTION OF THE PREFERRED EMBODIMENT(S)

Figure 1A:
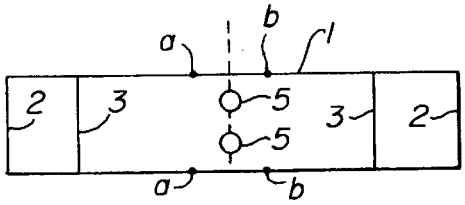
FIGS. 1A and 1B are diagrammatic side and top views, respectively, showing the basic construction of the planar radiation element equivalent to one wavelength according to this invention.
Figure 1B:
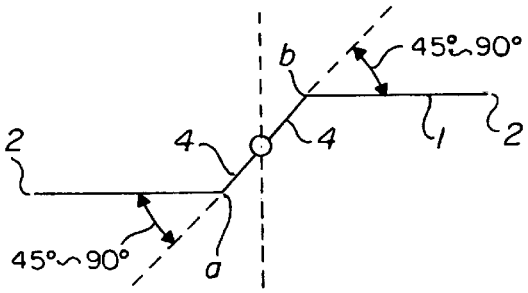

Referring now to FIGS. 1A and 1B, there are shown diagrams for explaining the basic elements of the construction of the omnidirectional antenna elements of this invention. FIGS. 1A and 1B show the construction of the antenna of this invention in accordance with one embodiment. The design is characterized by omnidirectionality with horizontal surface directionality which is approximately a circular shape. This results in a sufficiently decreased standing-wave ratio (hereinafter referred to as "SWR") so as to provide a very efficient antenna. FIG. 1A shows a front view and FIG. 1B shows a top view according to one embodiment of this invention. As shown in FIGS. 1A and 1B, the reference numeral 1 indicates the long side of the antenna element, and reference numeral 2 is the short side of the antenna element. The reference number 3 is a short or shorting bar, 4 is a refraction separation electro-conductive path (reflecting conductor), and reference numeral 5 is the feed point. Since the basic construction of the omnidirectional antenna of this invention as shown in FIG. 1 is two antenna elements, commonly called modified antenna elements, these two elements will be excited at the same time. Each end of the long side of the antenna receives one-half of the wavelength, while the short side of the antenna receives one-half to one-third of the wavelength received by the long side. The end of the long side element 1 closest to the short side antenna element 2 is provided with the short bar 3. This design of combining two modified antennas in this manner makes it possible to adjust the impedance to receive one wavelength at the selected frequency. The design also prevents reflected waves from being generated due to the close relationship between the feed point in the center of the radiating waves. In order to reduce SWR, the central part is bent at an angle of 45 degrees to 90 degrees with respect to the outer end of the flat frame as shown in FIG. 1B. The construction comprising short side 1 and long side 2 is further provided with refraction separation electro-conductive path (reflecting conductor) 4 and is $\frac{1}{10}$th to $\frac{1}{30}$th of the long side. Because feed point 5 is located in the geometrical center, a design is achieved which makes it possible to utilize centrally structured elements of multiple planar radiation elements equivalent to one wavelength and which are formed to enable excitation of two antenna elements located at a symmetrical distance as viewed from the feed point.

Figure 2:
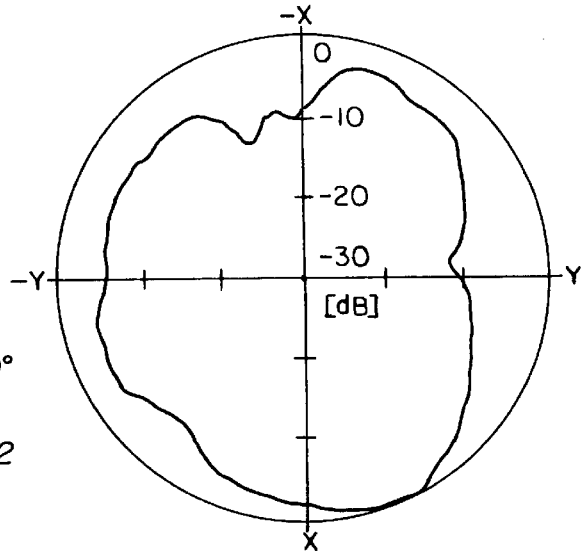
FIG. 2 shows the radiation pattern from actual measurement of a horizontal plane for a one-wavelength planar radiation antenna element according to one embodiment of this invention.
Figure 3:
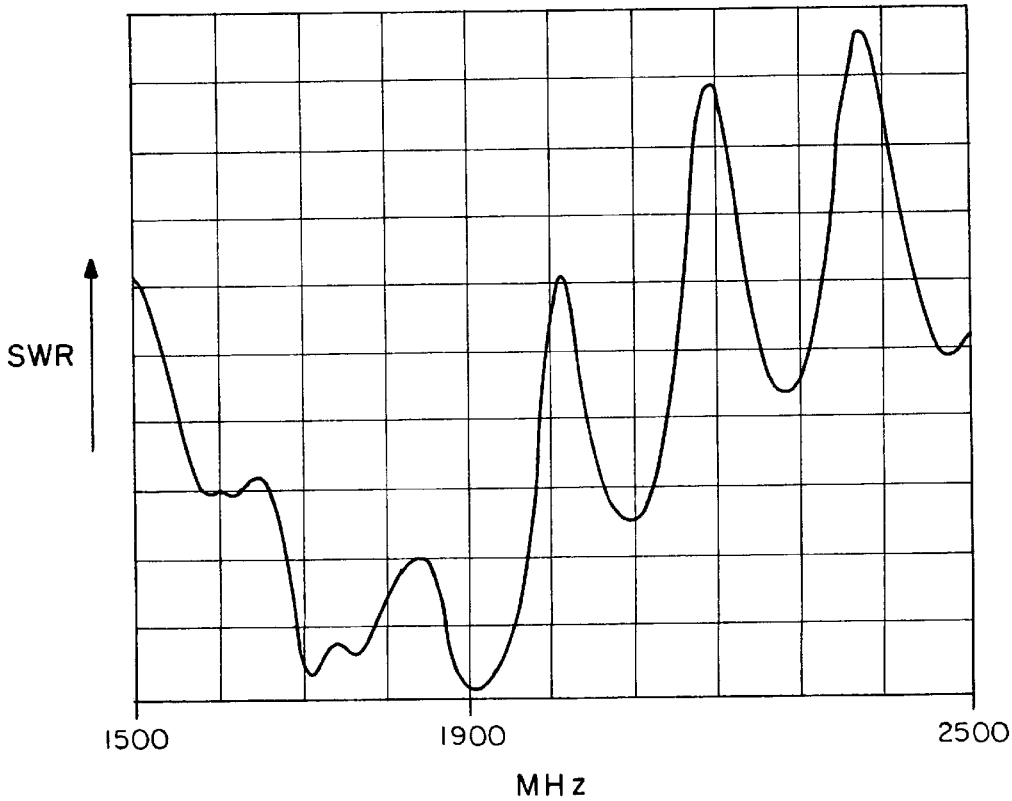
FIG. 3 is a graph indicating changes during measurement by a network analyzer of SWR (standing-wave ratio) between 1500 MHz and 2500 MHz for a planar radiation antenna element s invention having a long side equivalent to one wavelength at 1900 MHz.

Since the composite one-wavelength-element of the antenna of this invention consists of two parts which are linked in the center as shown in FIGS. 1A and 1B, the antenna has horizontal omnidirectional radiation characteristics which are almost circular. FIG. 2 shows the almost circular results from actual measurements or observations of the horizontal plane pattern of the one wavelength planar radiation element according to the teachings of this invention. In the example of FIG. 2, axes X and Y indicate the respective gains and the horizontal plane directional characteristics. Further, FIG. 3 is a diagram showing the changes of the SWR between 1500 MHz and 2500 MHz for an antenna element having a long side equivalent to one wavelength at 1900 MHz. Axis X indicates a frequency and axis Y indicates SWR. As shown, the SWR was significantly reduced when the frequency was 1900 MHz.

The antenna construction shown in FIGS. 4A and 4B and FIGS. 5A and 5B discussed below has almost complete omnidirectional characteristics in the vertical polarized wave mode and in the horizontally polarized wave mode, respectively, thereby providing a very efficient antenna.

Figure 4A:
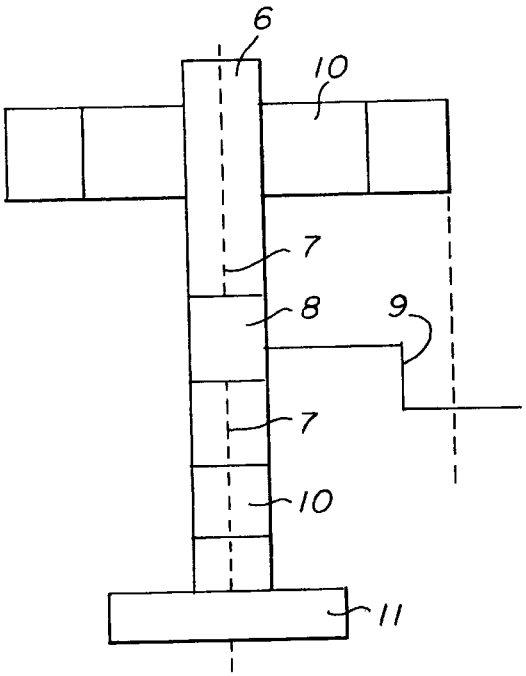
FIGS. 4A and 4B are front and top views, respectively, of an omnidirectional antenna in the vertical polarization mode according to one embodiment of this invention.
Figure 4B:
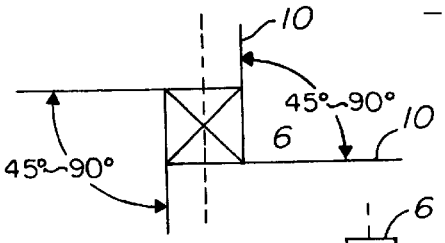

FIGS. 4A and 4B show an embodiment of the vertical polarization mode of an omnidirectional antenna in accordance with the present invention. FIG. 4A shows a front view, while FIG. 4B shows a top view. As shown in FIGS. 4A and 4B, reference number 6 represents an insulation support column, reference number 7 is a first feed cable, reference number 8 is an integrated feed circuit or a distributor, reference number 9 is a second feed cable, reference number 10 (two places) is a one-wavelength planar radiation element according to the teachings of this invention, and reference number 11 is the base part to support insulation column 6.

When a one-wavelength planar radiation element 10 is used with omnidirectional characteristics in the vertical polarization mode as shown in FIGS. 4A and 4B, one element 10 is mounted in the upper part of the insulation support column 6 and a second element 10 is deployed at a 90 degree angle with respect to the first element 10 and is also spaced approximately one wavelength from the first element 10. These two elements are connected with a cable 7 to integration feed or distribution circuit 8 with a feed or primary cable length equal to an odd numbered of ¼-wavelengths. The cable 7 will be a 75 ohm cable. A secondary 50-ohm or standard feed cable 9 having a length of even numbers of ½-wavelengths is connected to a transmitter-receiver (not shown).

Figure 5A:
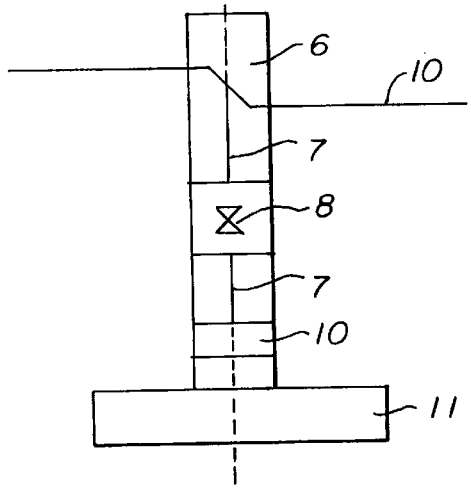
FIGS. 5A and 5B are front and top views, respectively, of an omnidirectional antenna similar to that shown in FIGS. 4A and 4B, except the antenna is in the horizontal polarization mode.
Figure 5B:
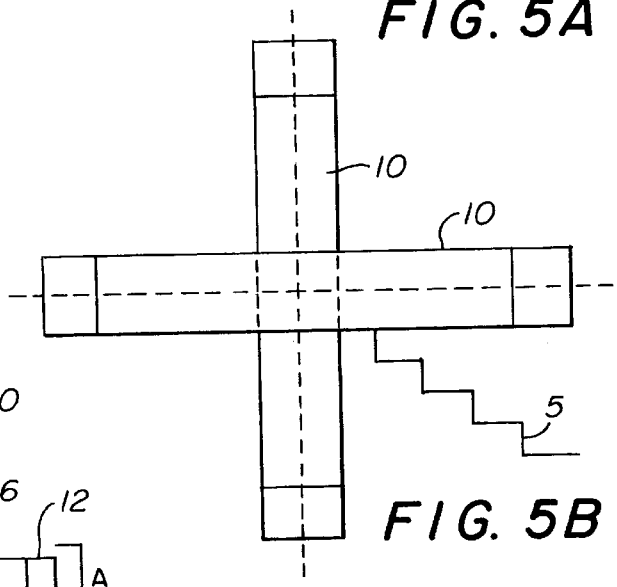
Figure 6:
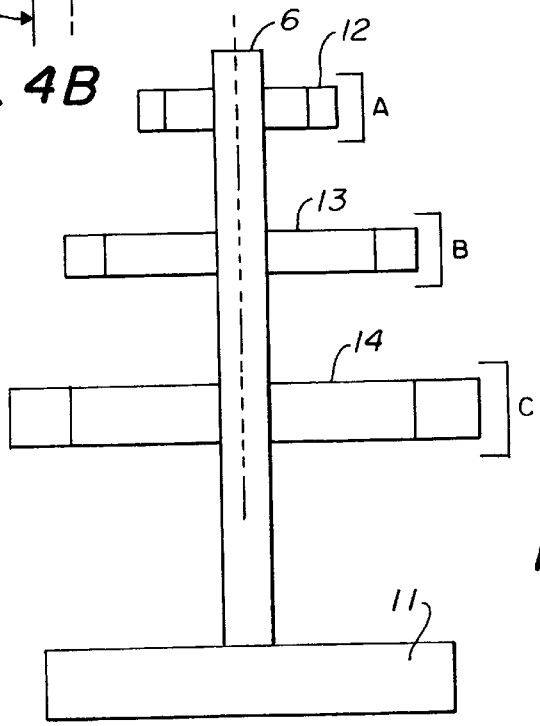
FIG. 6 shows a side view of an embodiment of this invention for multi-band purposes.

FIGS. 5A and 5B show side and top views, respectively, of an embodiment of the omnidirectional antenna of this invention in the horizontally polarized mode. As shown in FIG. 5A, 6 is an insulation support column, 7 is a primary feed cable, 8 is an integration feed cable (distributor), 9 is a secondary feed cable, 10 is a one-wavelength planar radiation element according to the teachings of this invention, and 11 is a base part for insulation support column 6. When the one-wavelength planar radiation element 10 is used with omnidirectional characteristics in the horizontal deflection mode as shown in FIG. 5, one element 10 is mounted in the upper part of insulation support column 6 and an identical element is at a crossing angle of 90 degrees to the first element 10 and with a spacing therebetween equivalent to one wavelength. These two elements are connected respectively to integration feed circuit 8 (distributor), the primary feed cable 7, and with the secondary cable 9 to a receiver-transmitter with the cable linking as described with respect to FIGS. 4A and 4B. When two elements spaced at different vertical locations are excited at the same time, it is possible to obtain almost completely non-directional characteristics having a horizontal plane pattern.

In the embodiments of FIGS. 5A and 5B, the set interval between the upper and lower one-wavelength planar radiation element must be at least equal to ½wavelength with the same polarization, the same frequency, and the same polarity (phase).

FIG. 6 shows an embodiment wherein three 1-wavelength planar radiation elements are deployed with sequential one-wavelength intervals for band A, band B, and band C in the vertical direction. The embodiment is designed for multiple station broadcasting at different high frequencies. Examples of such broadcasting include retransmission (with a repeater equipment) or relay use, or for multi-band use. In this case, antennas 12, 13, and 14 are one-wavelength planar radiation elements corresponding to the central frequencies of bands A, B, and C. It is also possible to utilize the same method with a super-gain design for broadcasting the same signal at the same frequency with multiple stages.

Although the deflection mode of waves will correspond to the input direction of a high-frequency current in the feed point, this standard antenna arrangement also makes it possible to add a small amount of polarized diversity characteristics through the changes of the vertical-horizontal ratio of the antenna elements. For example, with a vertical-horizontal ratio of each individual element of 1:3, it is about 20 percent. With a ratio of 1:2, proper polarization diversity characteristics will be created.

Figure 7A:
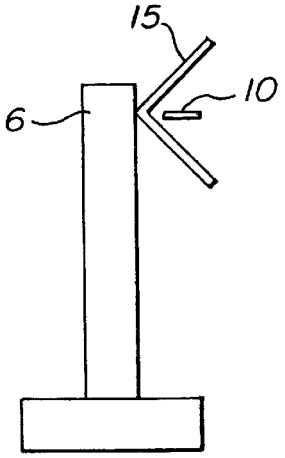
FIGS. 7A and 7B are side and top view, respectively, of another embodiment of this invention having a reflection plate added to the omnidirectional antenna in the horizontal polarization mode.
Figure 8A:
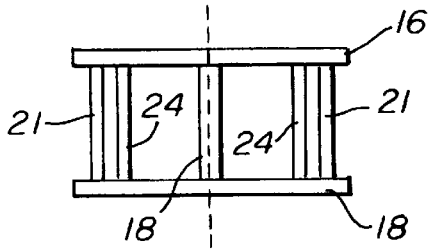
Figure 7B:
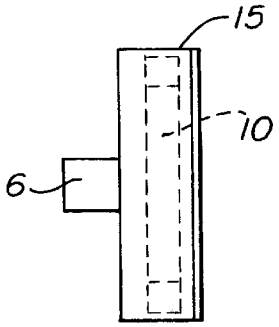
Figure 8B:
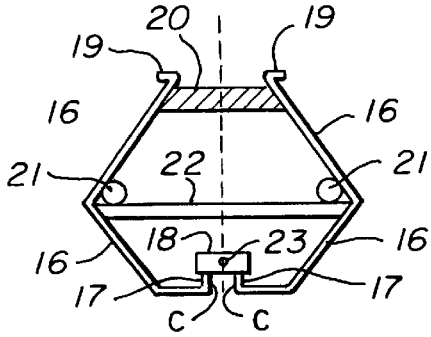
Figure 8C:
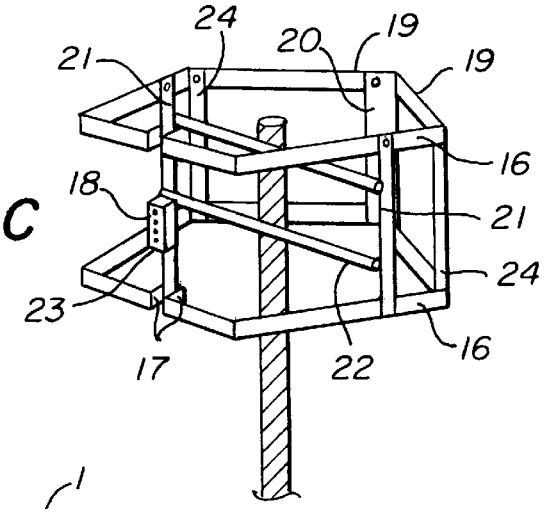

A further embodiment of this invention as shown in FIGS. 7A and 7B indicates an embodiment wherein reflecting plate 15 is deployed with an element in the horizontal polarization mode. The reflecting plate 15 has an angle of 90 degrees behind the element. The element may vary between 90 degrees (as shown) up to 120 degrees (not shown). It will be appreciated that it is desirable to provide this reflecting plate with a grid-like or perforated construction in order to reduce wind pressure. If the element is properly located and the angle of the reflection plate is correct, it is possible to achieve precise control over the covered area. Thus, it will be appreciated that this method is also effective for reception for use with mobile units. FIG. 8A shows a front view, while FIG. 8B shows a top view of still another embodiment of this invention. In addition, FIG. 8C shows a perspective view. As shown in FIGS. 8A, 8B, and 8C, reference number 16 represents the long side of the antenna element, reference number 17 provides a conductive path, reference number 18 is the feed point or box, reference number 19 is the short side of the antenna element reference number 20 is a spacer or gap-fixing member, reference number 21 is an insulation support column, reference number 22 is a cross-mount insulation member, reference number 23 is an insulation-type feed point, and reference number 24 is a short bar. Further, the design completely prevents problems related to directional characteristics and changes in the position of the two parties in communication with each other.

According to this embodiment, the long side of the antenna element is in the shape of a regular pentagon, wherein the total length of the entire periphery of the long side of the antenna element equals the length of one wavelength of the central frequency being received or transmitted. On one end, a part 19 is folded toward the outer side and is the short side of the antenna. This end part is fixed in place by insulation member 20. Feed point 23 is deployed in an extended part of conductive path 17, which is folded toward the inner side. This creates a construction in which reflection waves are eliminated. The short bars 24 are located near the ends of long side 16 and are of a slidable design. This enables movement of the elements in the vertical direction and adjustment to the left and right to enable tuning. The gain of this antenna can reach 5.5 db and its SWR can be adjusted to almost 1.1. The direction characteristics of this design are substantially circular such that changes of the position of the two communication parties does not create problems. Since the short bar is mounted at a location in the vicinity of about 30 percent of the peripheral length of the long side, the antenna element is adjustable and energizing is enabled in the vertical direction while an adjustment can also be performed to the left and to the right. The gain of this antenna can reach 3.5 db, and thanks to its right circular construction, its directional characteristics are such that changes of the respective positions of the communication parties create no problems whatsoever. In addition, because the SWR is reduced, the antenna achieves high gain even with a somewhat broad frequency width.

Figure 9:
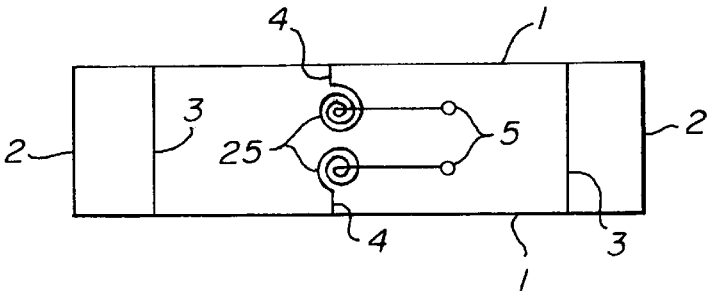
FIG. 9 is a side view of still another embodiment of the planar radiation antenna element of this invention.

According to the embodiment in FIG. 9, reference numeral 1 represents the long side of the antenna element, reference numeral 2 represents the short side of the antenna element, reference numeral 3 is a short bar, reference numeral 4 is a feed path, reference numeral 25 is a spider coil, and reference numeral 5 is a feed point. According to this embodiment, long side 1 corresponds to one-fourth of a wavelength, and antenna element short side 2 corresponds to one-twelfth of a wavelength. Short bar 3 is provided on the side that is close to the short side of the antenna element and in order to enable an adjustment of the impedance by relative movement of the two long sides, coil 25 is wound along its length which corresponds to one-third of a wavelength. A compact-type planar radiation antenna element connected to such a coil and having the same construction as the basis construction shown in FIG. 8 makes it possible to attain an even more compact design of an omnidirectional antenna.

Thus, as has been explained above, this invention makes it possible to solve the problems of conventional radio antennas for transmission of radio waves which can be used for relay, broadcasting, communication, and other purposes. The antenna of this invention makes it possible to select at will any directional characteristics of horizontally polarized waves, vertically polarized waves, or a suitable polarized wave composition. These directional characteristics realize non-directional characteristics of an antenna with a nearly completely horizontal plane. In addition, since the terminal of this antenna is an open type of terminal, it offers little resistance to wind pressure thereby resulting in strong resistance to wind damage.

This antenna is further characterized by the fact that it can operate at a relatively lower height than an antenna mounted on a dipole or a ground pole, and the reflection angle of the wave is much lower than that of a ground pole or dipole. Further, because the antenna can be set up with one mast, use of the antenna can be sequentially changed while the antenna is operated. Another characteristic of this antenna is that it can be used for multi-bands or multi-stations. Since grounding is not required regardless of the wave band which is used, no grounding rod is necessary. This makes the antenna easy to use and carry (via ship, a plane, a rocket, etc.).

Another extremely effective feature of this invention is the fact that all of the above-described advantages and characteristics can easily be realized in the UHF band with a compact antenna. Moreover, when this antenna is used in the horizontal polarized mode, errors are greatly reduced during transmission of digital information while also enabling a complete control over the covered area.

The corresponding structures, materials, acts, and equivalents of all means or step plus function elements in the claims below are intended to include any structure, material, or act for performing the function in combination with other claimed elements as specifically claimed.

I claim:

1. A flat surface or planar antenna element for an antenna comprising:

a first frame-type antenna element with a pair of short side portions, a pair of long side portions, and a feed point mounted to the long side, said element having a short side ratio to the long side ratio of between about 1:4 and 1:8 and wherein the length of a long side portion is approximately equal to the wavelength of a first selected frequency and the short side portion is between about ⅓ to about ½ the length of the long side portion, said feed point being located at approximately the central point of the long side, such that each of said two short side portions and long side portions may be excited at the same time;

a short bar mounted at a selected distance from both end points of said pair of long sides;

the short sides mounted on the end points of said pair of long sides so as to form a frame-type antenna element having a perimeter forming an endless conductor; and said pair of long sides being formed symmetrically around a central portion of said long sides such that a first portion at one end of a long side is bent at an angle of between 45 degrees and 90 degrees with respect to said central portion and a second portion at the other end is bent so as to be parallel to said first portion, and said first and second portions extend from said central portion in opposite directions from each other.

2. The antenna element of claim 1 and further comprising:

an upright support column and said antenna element being mounted thereto;

a second frame-type antenna element spaced from said first frame-type antenna element at a distance of between ½-wavelength and 1-wavelength of the central frequency and positioned so as to be at an angle of 90 degrees with said first frame-type antenna element; and said first and second frame-type antenna elements being selectively oriented to operate in one of the horizontal and the vertical wave polarization modes so as to produce a first omnidirectional antenna with a construction enabling simultaneous excitation of the same phase or a phase difference of 90 degrees.

3. A dual frequency omnidirectional antenna constructed from the antenna element of claim 2 and further comprising:

an upright insulation support column with said first omnidirectional antenna produced by said first and second frame-type antenna elements being mounted thereto;

a second omnidirectional antenna produced by third and fourth frame-type antenna elements, the long side length of said third and fourth elements are approximately equal to the wavelength of a second selected frequency different from said first selected frequency; and said second omnidirectional antenna mounted to said support column at a selected distance from said first omnidirectional antenna so as to receive/transmit at two different wavelengths.

4. The antenna of claim 3 and further comprising a third omnidirectional antenna produced by fifth and sixth frame-type antenna elements, said elements having a long side approximately equal to the wavelength of a third selected frequency different from said first and second selected frequencies and mounted to said support column at a second selected distance from said second antenna element so as to receive/transmit at three different wavelengths.

5. An antenna element comprising:

a frame-type element with a pair of short side portions, a pair of long side portions, and a feed point mounted to the long side, said element having a short side ratio to the long side ratio of between about 1:4 and 1:8 and wherein the long side length is approximately equal to the wavelength of a first selected frequency, said feed point being located at approximately the central point of the long side;

said long side being formed in the shape of a regular polygon having an odd number of angles and an odd number of sides such that the end points of the long side are located adjacent to each other in a non-contacting manner to form one of the angles and are bent to form said short sides, the centermost side of said regular polygon being bent at a central point to create the center of the regular polygon;

an insulation member connected between the two end points of said long sides so as to maintain a constant gap therebetween;

a feed point formed at the central portion of said centermost side of said polygon; and a pair of short bars mounted one each at a selected distance from both end points.

* * * * *